US007007756B2

(12) United States Patent
Lerche et al.

(10) Patent No.: US 7,007,756 B2
(45) Date of Patent: Mar. 7, 2006

(54) PROVIDING ELECTRICAL ISOLATION FOR A DOWNHOLE DEVICE

(75) Inventors: Nolan C. Lerche, Stafford, TX (US); James E. Brooks, Manvel, TX (US); Choon Fei Wong, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 111 days.

(21) Appl. No.: 10/717,872

(22) Filed: Nov. 20, 2003

(65) Prior Publication Data

US 2004/0108114 A1 Jun. 10, 2004

Related U.S. Application Data

(60) Provisional application No. 60/428,603, filed on Nov. 22, 2002.

(51) Int. Cl.
*E21B 43/11* (2006.01)

(52) U.S. Cl. ..... 166/297; 166/65.1

(58) Field of Classification Search ..... 166/297, 166/298, 65.1; 102/202.5
See application file for complete search history.

(56) References Cited

U.S. PATENT DOCUMENTS 4,763,259 A * 8/1988 Delatorre et al. ..... 702/11
5,088,413 A 2/1992 Huber et al.
5,347,929 A 9/1994 Lerche et al.
5,505,134 A 4/1996 Brooks et al.
5,811,894 A 9/1998 Buyers et al.
6,148,263 A * 11/2000 Brooks et al. ..... 702/6
6,283,227 B1 9/2001 Lerche et al.
6,385,031 B1 * 5/2002 Lerche et al. ..... 361/248
6,386,108 B1 * 5/2002 Brooks et al. ..... 102/217
6,577,244 B1 * 6/2003 Clark et al. ..... 340/854.6
6,604,584 B1 8/2003 Lerche et al.
6,752,083 B1 * 6/2004 Lerche et al. ..... 102/202.7
2001/0027864 A1 10/2001 Vaynshteyn
2001/0040030 A1 11/2001 Lerche et al.
2002/0048135 A1 4/2002 Lerche et al.
2002/0062991 A1 5/2002 Farrant et al.
2002/0088620 A1 7/2002 Lerche et al.
2003/0137429 A1 * 7/2003 Clark et al. ..... 340/854.5
2005/0045331 A1 3/2005 Lerche et al.

FOREIGN PATENT DOCUMENTS

GB 2385343 A 8/2003
WO WO 00/20820 A2 4/2000

* cited by examiner

*Primary Examiner*—William Neuder
(74) *Attorney, Agent, or Firm*—Trop, Pruner & Hu, P.C.; Bryan P. Galloway; Jaime A. Castano

(57) ABSTRACT

An isolation apparatus is provided between an electrical conductor and an electrically-activated well tool. The isolation apparatus has a blocking element to enable a signal having a first electrical polarity to pass through the element. The blocking element blocks a signal having a second electrical polarity.

29 Claims, 3 Drawing Sheets

PROVIDING ELECTRICAL ISOLATION FOR A DOWNHOLE DEVICE

CROSS REFERENCE TO RELATED APPLICATION

This claims the benefit under 35 U.S.C. § 119(e) of U.S. Provisional Patent Application Ser. No. 60/428,603, entitled "Universal Tractor Safety Sub," filed Nov. 22, 2002.

BACKGROUND

During well completion or well production operations, various types of tools are run into a wellbore. These tools include those that are controlled by electrical signaling. Typically, electrical signaling is provided down an electrical conductor, such as through a wireline or other conduit, to a downhole component. In other types of arrangements, inductive coupling mechanisms can be used to communicate electrical signaling to the downhole components.

A safety issue associated with the use of electrical signaling is that downhole components may be inadvertently activated by unexpected signals, such as by electrical voltage or current spikes, failure of downhole components (shorts, open circuits, and so forth), and other failures. If the downhole component that is activated electrically is a perforating gun, then the perforating gun may be shot before the perforating gun has been lowered to the desired depth. If the inadvertent shooting occurs near the well surface, serious injury to well operators may occur. In other examples, packers may be inadvertently set, downhole components may be inadvertently dropped due to unexpected activation of an electrically-activated release mechanism, and so forth.

SUMMARY

In general, methods and apparatus are provided to provide isolation of electrical signaling from downhole components. For example, an isolation apparatus between an electrical conductor and an electrically-activated well tool has a blocking element to enable a signal having a first electrical polarity to pass through the element, and the blocking element to block a signal having a second electrical polarity.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "up" and "down"; "upper" and "lower"; "upwardly" and "downwardly"; "upstream" and "downstream"; "above" and "below"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

An isolation assembly according to some embodiments includes components that isolate electrical or other types of signals from reaching a downhole device (or plural downhole devices). For example, a tool string may include a tractor for running the tool string into the wellbore, which can be a deviated or horizontal wellbore. The tractor has a power supply, either a direct current (DC) or alternating current (AC) power supply, or both, which may generate electrical signaling in the tool string. The isolation assembly is provided to prevent unsolicited electrical signaling of the tractor from migrating to another downhole device (such as a perforating gun string, a release mechanism, and so forth) in the tool string. In other embodiments, other components including power sources may be present in the tool string. The isolation assembly can similarly be used to isolate inadvertent electrical signaling from such power sources from migrating to a downhole device. In yet a different arrangement, the power source may be provided at the well surface, in which case the isolation assembly is used to isolate electrical signaling from the well surface power source from inadvertently reaching a downhole component.

Figure 1:
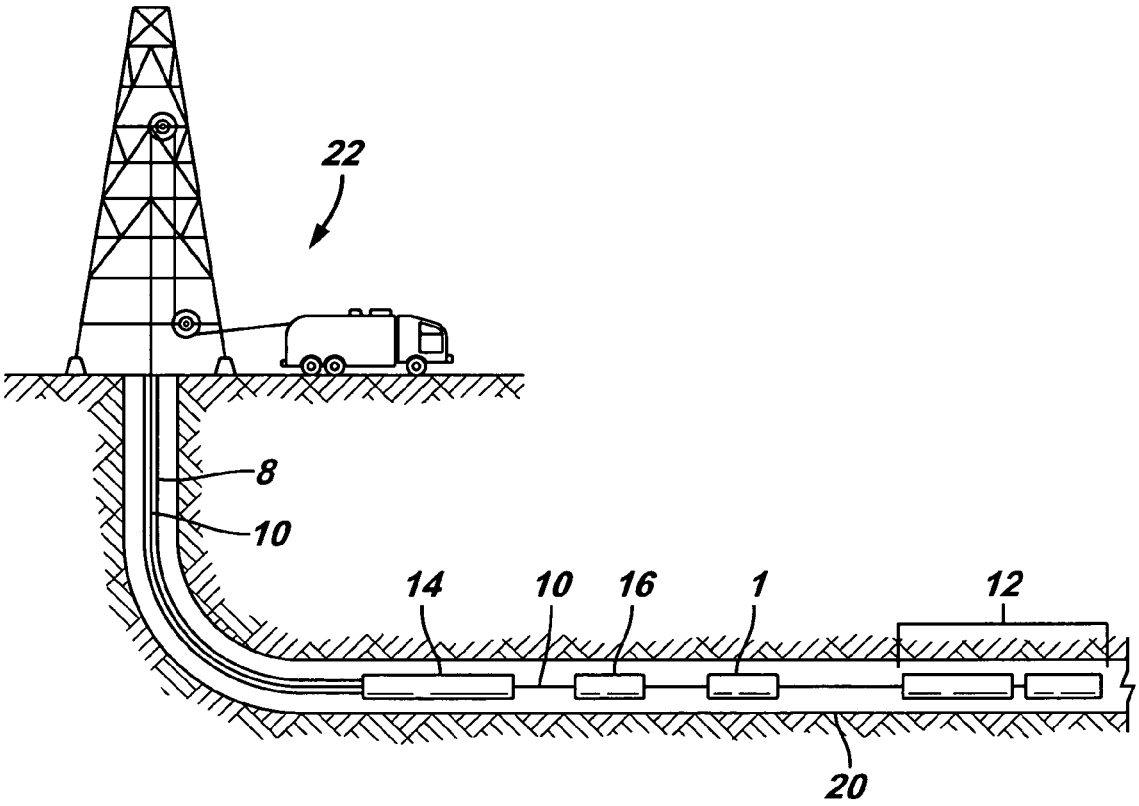
FIG. 1 illustrates an example tool string that is run into a wellbore, the tool string including a tractor, a perforating gun string, and an isolation sub between the tractor and the perforating gun string.

FIG. 1 illustrates a tool string that is run into a wellbore 20. In the example shown, the wellbore 20 is a generally horizontal wellbore. In other embodiments, the tool string depicted in FIG. 1 can be used in other types of wellbores.

The tool string of FIG. 1 includes a carrier line 8, which contains an electrical conduit 10 for providing electrical signaling to the tool string. Examples of the carrier line 8 include a wireline, coiled tubing, and so forth. In an alternative embodiment, instead of the electrical conduit 10, a fiber optic line can be used to provide signaling to the tool string.

The tool string also includes a tractor 14, a casing collar locator (CCL) 16, and a perforating gun string 12. To provide electrical isolation, an isolation sub 1 is provided between the tractor 14 and the perforating gun string 12. Other components may also be present in the tool string that are not shown in FIG. 1.

The tractor 14 includes an AC and/or a DC power supply to provide power to the tractor 14. Essentially, the tractor 14 is used to move the tool string inside the wellbore 20. If AC or DC electrical signaling is allowed to migrate from the tractor 14 to the perforating gun string 12, inadvertent activation of the perforating gun string 12 may occur, which may cause damage or injury. In a different arrangement, instead of a perforating gun string 12, another tool can be connected to the tool string below the isolation sub 1. Examples include an electrically-activated packer, an electrically-activated release mechanism, and so forth. In each of such cases, it may be desired to prevent inadvertent activation of such tools due to migration of AC or DC electrical signaling from a power source in the tool string or at the well surface.

To prevent inadvertent activation of the perforating gun string 12, the isolation sub 1 is provided above the perforating gun string 12 so that electrical signaling from either the tractor 14 or from surface equipment 22 is blocked from the perforating gun string 12 until the well operator desires to activate the perforating gun string 12.

The perforating gun string 12 is an addressable gun string that has various switches that are addressable by respective different addresses. In other words, the perforating gun string 12 has several sections, with a first section activated by a first address, a second section activated by a second address, and so forth. In other embodiments, instead of an addressable perforating gun string, a non-selective perforating gun may be employed.

The isolation sub 1 is adapted to provide protection against migration of electrical signaling (AC or DC) of both positive and negative polarities. The isolation sub 1 blocks all positive voltages up to a predetermined threshold. Also, negative voltages that exceed a predetermined threshold are shunted by an element in the isolation sub 1. Optionally, the isolation sub 1 also provides radio frequency (RF) protection by filtering RF signaling such that the RF signaling does not reach the perforating gun string 12. In some cases, stray RF signaling may cause inadvertent activation of the perforating gun string 12 (or other downhole component).

According to some implementations, the isolation sub 1 also includes an addressable switch that can be activated by a predetermined address communicated over the electrical conduit 10. The addressable switch in the isolation sub 1 is activated to enable connection of electrical signaling to the perforating gun string 12.

Figure 2:
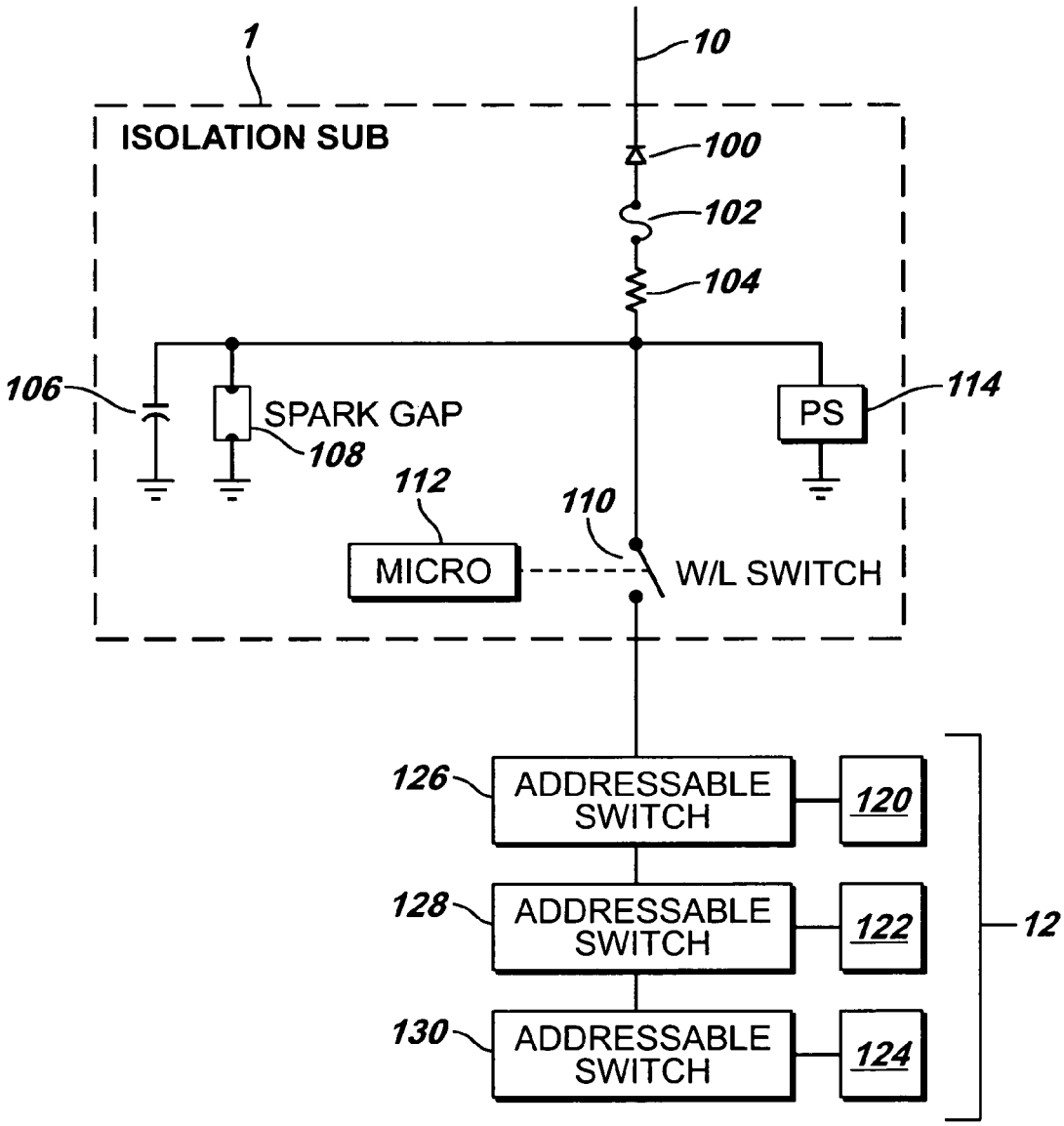
FIG. 2 is a block diagram of the isolation sub according to one embodiment.

Referring to FIG. 2, portions of the isolation sub 1 and the perforating gun string 12 are illustrated in greater detail. The isolation sub 1 includes one or more blocking diodes 100 to block a positive voltage appearing on an electrical conductor 150 in the electrical conduit 10. In one example implementation, each blocking diode 100 blocks up to 1,500 volts (V) of positive voltage on the electrical conductor 10. If two blocking diodes 100 are used, then a positive voltage of 3,000 V can be blocked. A higher positive voltage can be blocked by connecting additional blocking diodes in series.

Also connected in series with the one or more blocking diodes 100 is a fuse 102 that is set to disintegrate in response to greater than a certain amount of current passing through the fuse 102. The fuse 102 is provided to protect against high current of a negative voltage, as described in further detail below. Optionally, a resistor 104 can also be provided in series with the fuse 102. The resistor 104 works in conjunction with a capacitor 106 to provide a filter to filter out unwanted RF signaling. Stray RF signaling may inadvertently activate the perforating gun string 12. By filtering out such RF signaling, the isolation sub 1 effectively blocks unwanted RF signaling from the perforating gun string 12.

The isolation sub 1 also includes a spark gap 108, which is connected in parallel with the capacitor 106. The spark gap 108 is set to conduct in response to negative voltage across the spark gap of greater than predetermined magnitude. Thus, if the magnitude of the negative voltage appearing across the spark gap 108 is less than the predetermined magnitude, then the spark gap 108 remains off and thus does not conduct. However, if the magnitude of the negative voltage across the spark gap 108 is greater than the predetermined magnitude, then the spark gap 108 conducts and effectively shunts current away from a switch 110. When the spark gap 108 starts conducting, high current travels through the fuse 102 to thereby blow the fuse 102. Blowing of the fuse 102 occurs relative fast (on the order of microseconds) so that a negative voltage that has a excessively high magnitude is shunted away from the switch 110 to protect the switch 110.

More generally, a clamp (instead of a spark gap) is used, with the clamp being responsive to a negative voltage of greater than a predetermined magnitude by turning on and electrically conducting.

The switch 110 is an addressable switch that is controllable by a microcontroller 112 coupled to the switch 110. The microcontroller 112 receives activation signaling communicated down the electrical conductor 150. The microcontroller 112 can also be responsive to other forms of signaling in other implementations. If the activation signaling contains an address corresponding to the switch 110, the microcontroller 112 activates the switch 110 to a closed position such that subsequent electrical signaling appearing on the electrical conductor 150 can be communicated to the perforating gun string 12.

The isolation sub 1 also includes a power supply 114 to provide power to the microcontroller 112 and other components in the isolation sub 1.

The perforating gun string 12 includes three detonator assemblies 120, 122, and 124, which are activated by respective addressable switches 126, 128, and 130. Each of the addressable switches 126, 128, and 130 is responsive to a signal having a unique address. A switch 126, 128, or 130 that receives an activation signal having the correct address causes activation of the respective detonator assembly, to thereby fire explosives associated with the detonator assembly. In a different embodiment, a different number of detonator assemblies are present in the perforating gun string 12.

Figure 3:
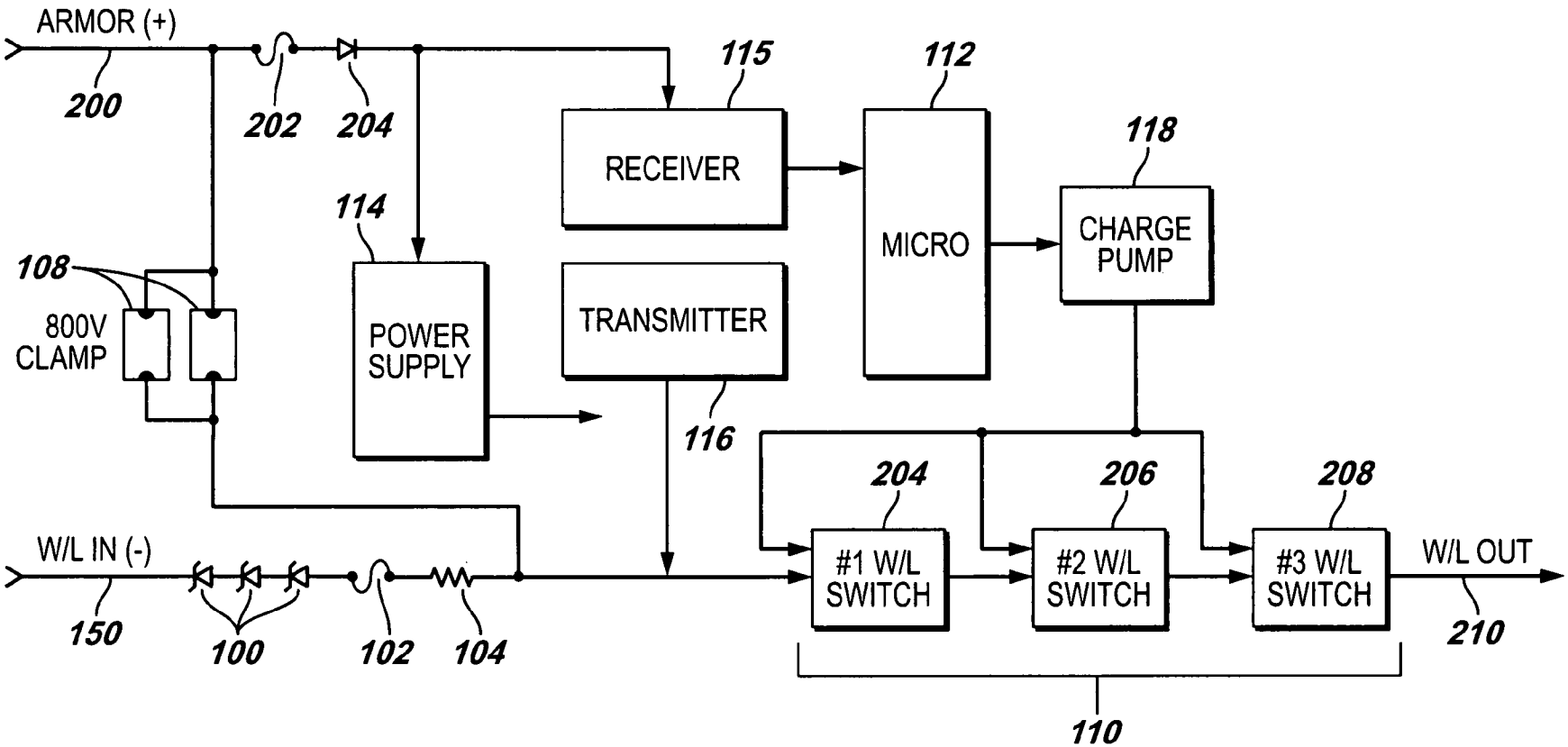
FIG. 3 is a more detailed block diagram of the isolation sub of FIG. 2.

FIG. 3 illustrates an even more detailed depiction of the isolation sub 1. Three series blocking diodes 100 (instead of the one shown in FIG. 2) are connected to the electrical conductor 150. Two spark gaps 108 (instead of the one spark gap shown in FIG. 2) are provided in parallel to provide redundancy in case one of the spark gaps 108 fails.

The electrical conduit 10 (FIG. 1) also includes a reference conductor, which is depicted as 200 in FIG. 3. A fuse 202 is connected to the reference conductor 200, and a diode 204 is connected in series with the fuse 202. The fuse 202 is provided to protect low-voltage components in the isolation sub 1, such as the microcontroller 112, a receiver 115, and a transmitter 116. The receiver 115 is able to detect electrical signaling having a predefined signature, which corresponds to the address of the switch 110 (FIG. 2). In one implementation, the receiver 115 is a frequency shift key (FSK) receiver. The transmitter 116 enables the microcontroller 112 to communicate signaling up the electrical conduit 10 to the well surface or to other components in the tool string.

A charge pump 118 is also provided in the isolation sub 1, with the charge pump 118 coupled to an output of the microcontroller 112. The charge pump 118 pumps up the voltage of activation signals to switches 204, 206, and 208, which are all part of the switch 110 depicted in FIG. 2. Multiple switches 204, 206, and 208 are provided in case of failure of any of the switches. For example, if the switch 204 should fail by shorting, switches 206 and 208 can continue to provide isolation of electrical signaling of the electrical conductor 150 from an output electrical conductor 210 that is connected to the perforating gun string 12.

The isolation switches 204, 206, and 208 are designed to withstand an input voltage on the electrical conductor 150 of greater than a predetermined magnitude (e.g., 1000 volts). In one example implementation, each switch 204, 206, and 208 is implemented with a power field effect transistor (FET).

By using the isolation assembly according to some embodiments, effective protection against stray electrical signaling is provided. As used here, "electrical signaling"

refers to any type of electrical voltage or current that is in the electrical conduit 10. Thus, electrical signaling is intended to encompass power voltages and currents, as well as signals used for controlling activation of elements in the tool string. The likelihood of damage to downhole equipment, as well as injury to well personnel, is reduced by using the electrical isolation assembly according to some embodiments.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A tool string for use in a well, comprising:

an electrical conductor;

an electrically-activated well tool having a switch and an electrically-activated component coupled to the switch; and an isolation apparatus between the electrical conductor and the well tool, the isolation apparatus comprising a blocking element to enable a signal having a first electrical polarity to pass through the element, and the blocking element to block a signal having a second electrical polarity from reaching the switch in the well tool.

2. The tool string of claim 1, wherein the blocking element comprises plural diodes.

3. The tool string of claim 1, further comprising a first switch coupled to the electrical conductor, the first switch activatable to enable communication of a signal from the electrical conductor to the electrically-activated well tool.

4. The tool string of claim 3, wherein the isolation apparatus further comprises a control unit to control activation of the first switch.

5. The tool string of claim 1, wherein the switch in the well tool is responsive to a first address, and the isolation apparatus has a receiver responsive to a second address.

6. The tool string of claim 1, wherein the well tool includes additional switches and additionally electrically-activated components coupled to respective additional switches, the blocking element to block the signal having the second electrical polarity from reaching any of the switches.

7. A tool string for use in a well, comprising:

an electrical conductor;

an electrically-activated well tool; and an isolation apparatus between the electrical conductor and the well tool, the isolation apparatus comprising a blocking element to enable a signal having a first electrical polarity to pass through the element, and the blocking element to block a signal having a second electrical polarity from passing through the blocking element, wherein the first electrical polarity is a negative polarity, and the second electrical polarity is a positive polarity.

8. The tool string of claim 7, wherein the blocking element comprises one or plural diodes.

9. The tool string of claim 7, wherein the isolation apparatus further comprises an element to switch on in response to the signal of the first electrical polarity having a voltage greater than a predetermined magnitude.

10. The tool string of claim 9, wherein the isolation apparatus further comprises a fuse adapted to be blown by current passing through the fuse in response to the element switching on.

11. The tool string of claim 10, wherein the element comprises a spark gap.

12. The tool string of claim 9, wherein the element comprises a clamp adapted to conduct current in response to the signal of the first electrical polarity having the voltage greater than the predetermined magnitude.

13. A tool string for use in a well, comprising:

an electrical conductor;

an electrically-activated well tool;

an isolation apparatus between the electrical conductor and the well tool, the isolation apparatus comprising a blocking element to enable a signal having a first electrical polarity to pass through the element, and the blocking element to block a signal having a second electrical polarity from passing through the blocking element; and a first switch coupled to the electrical conductor, the first switch activatable to enable communication of a signal from the electrical conductor to the electrically-activated well tool, wherein the isolation apparatus further comprises a control unit to control activation of the first switch, wherein the isolation apparatus further comprises one or more additional switches in series with the first switch, the control unit to control activation of the switches.

14. A tool string for use in a well, comprising:

an electrical conductor;

an electrically-activated well tool; and an isolation apparatus between the electrical conductor and the well tool, the isolation apparatus comprising a blocking element to enable a signal having a first electrical polarity to pass through the element, and the blocking element to block a signal having a second electrical polarity from passing through the blocking element, wherein the isolation apparatus further comprises a filter to block radio frequency signals from reaching the electrically-activated well tool.

15. A tool string for use in a well, comprising:

an electrical conductor;

an electrically-activated well tool;

an isolation apparatus between the electrical conductor and the well tool, the isolation apparatus comprising a blocking element to enable a signal having a first electrical polarity to pass through the element, and the blocking element to block a signal having a second electrical polarity from passing through the blocking element; and a tractor, the isolation apparatus between the tractor and the well tool.

16. The tool string of claim 15, wherein the tractor has a power supply, and the tractor is electrically connected to the electrical conductor.

17. The tool string of claim 16, wherein the power supply comprises at least one of an alternating current (AC) power supply and a direct current (DC) power supply.

18. An apparatus to isolate signaling in an electrical conduit from a downhole device, the apparatus comprising:

a blocking element adapted to enable a signal having a first electrical polarity to pass through, the blocking element adapted to block a signal having a second electrical polarity from passing through the blocking element; and a clamp adapted to electrically conduct in response to the signal of the first electrical polarity having greater than a predetermined magnitude.

19. The apparatus of claim 18, wherein the clamp comprises a first spark gap.

20. The apparatus of claim 19, further comprising a redundant spark gap connected in parallel with the first spark gap.

21. The apparatus of claim 18, further comprising a switch to block a signal in the electrical conduit from the downhole device when the switch in open.

22. The apparatus of claim 21, further comprising a control unit to activate the switch to electrically connect the signal in the electrical conduit to the downhole device.

23. An isolation assembly to isolate a downhole component from electrical signaling in an electrical conduit, comprising:

a diode to block electrical signaling in the electrical conduit having a positive polarity;

a switch having an open state and a closed state, the switch in the open state to block electrical signaling in the electrical conduit from communicating to the downhole component, and the switch in the closed state to communicate electrical signaling in the electrical conduit to the downhole component; and a fuse in series with the diode.

24. The isolation assembly of claim 23, further comprising a clamp that is adapted to electrically conduct in response to electrical signaling having a negative polarity, the diode to enable the electrical signaling having the negative polarity to pass through to the clamp.

25. The isolation assembly of claim 24, wherein conduction in the clamp causes blowing of the fuse.

26. The isolation assembly of claim 23, further comprising a control unit to activate the switch between the open state and the closed state.

27. A method for use in a wellbore, comprising:

providing a tool string having an electrical conduit, an electrically-activated tool, and an isolation assembly between the electrical conduit and the electrically-activated tool;

blocking electrical signaling of a first polarity with a blocking element in the isolation assembly;

enabling electrical signaling of a second polarity to pass through the blocking element; and activating a clamp to electrically conduct in response to the electrical signaling of the second polarity having greater than a predetermined magnitude.

28. The method of claim 27, wherein blocking the electrical signaling of the first polarity is performed by a diode.

29. The method of claim 27, further comprising activating a switch in the isolation assembly between an open state and a closed state, wherein the switch in the open state blocks electrical signaling in the electrical conduit from the electrically-activated tool, and the switch in the closed state enables communication of electrical signaling in the electrical conduit with the electrically-activated tool.

* * * * *